US006755003B1

(12) United States Patent
McGrath et al.

(10) Patent No.: US 6,755,003 B1
(45) Date of Patent: Jun. 29, 2004

(54) RESILIENT CONSTRUCTION MEMBER

(75) Inventors: Ralph D. McGrath, Granville, OH (US); Frank C. O'Brien-Bernini, Granville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/209,308

(22) Filed: Dec. 11, 1998

(51) Int. Cl.[7] ..... E04C 3/30; E04H 12/00

(52) U.S. Cl. ..... 52/729.1; 52/729.2; 52/729.3; 52/729.4; 52/729.5; 52/650.1

(58) Field of Search ..... 52/729.1, 729.2, 52/729.3, 729.4, 729.5, 650.1, 145

(56) References Cited

U.S. PATENT DOCUMENTS

| | | | | | |
|---|---|---|---|---|---|
| 1,610,578 | A | | 12/1926 | Murphy | |
| 1,732,348 | A | | 10/1929 | Balduf | |
| 1,894,933 | A | | 1/1933 | Venzie | |
| 1,946,560 | A | | 2/1934 | Wick | |
| 2,026,117 | A | | 12/1935 | Balduf | |
| 3,046,620 | A | | 7/1962 | Tvorik et al. | |
| 3,229,435 | A | | 1/1966 | Olsen | |
| 3,324,615 | A | | 6/1967 | Zinn | |
| 3,349,535 | A | * | 10/1967 | Balinski | |
| 3,445,975 | A | | 5/1969 | Nelsson | |
| 3,609,933 | A | * | 10/1971 | Jahn et al. | 52/461 |
| 3,950,912 | A | | 4/1976 | Lundberg et al. | |
| 3,995,403 | A | * | 12/1976 | Nickell | 52/284 |
| 3,999,343 | A | | 12/1976 | Roberts | |
| 4,224,776 | A | * | 9/1980 | Hammerschlag | 52/645 |
| 4,456,497 | A | * | 6/1984 | Eberle | |
| 4,466,225 | A | | 8/1984 | Hovind | |
| 4,947,612 | A | * | 8/1990 | Taylor | |
| 5,079,894 | A | | 1/1992 | Lau | |
| 5,605,024 | A | * | 2/1997 | Sucato | |
| 5,661,273 | A | | 8/1997 | Bergiadis | |
| 5,974,760 | A | * | 11/1999 | Tingley | |
| 6,138,427 | A | * | 10/2000 | Houghton | 52/655.1 |
| 6,237,303 | B1 | * | 5/2001 | Allen et al. | 52/729.1 |
| 6,343,830 | B1 | * | 2/2002 | Ingram et al. | 296/168 |
| 6,484,460 | B2 | * | 11/2002 | Van Haitsma | 52/293.1 |
| 6,490,841 | B2 | * | 12/2002 | Hynes | 52/729.2 |
| 2002/0053180 | A1 | * | 5/2002 | McGrath et al. | 52/726.2 |
| 2002/0066253 | A1 | * | 6/2002 | Smith | 52/729.1 |
| 2002/0157329 | A1 | * | 10/2002 | Berdan, II | 52/144 |

FOREIGN PATENT DOCUMENTS

| | | | | |
|---|---|---|---|---|
| BE | 872 894 | A | | 4/1979 |
| CH | 552 110 | A | | 7/1974 |
| DE | 18 14 435 | A | | 6/1970 |
| DE | 17 84 729 | A | | 8/1971 |
| EP | 0 136 618 | A | * | 4/1985 |
| EP | 0 745 470 | A | | 12/1996 |
| GB | 630 311 | A | | 10/1949 |
| WO | 91 02865 | A | | 3/1991 |

* cited by examiner

*Primary Examiner*—Carl D. Friedman
*Assistant Examiner*—Kevin McDermott
(74) *Attorney, Agent, or Firm*—Inger H. Eckert; Stephen W. Barns; Maria C. Gasaway

(57) ABSTRACT

A construction beam includes a pair of lateral members and a resilient web extending therebetween, so as to present a cross-sectional profile corresponding to commonly used construction beam members. The resilience of the web helps to attenuate sound transmission through the beam from one lateral member to the other. Ends of the resilient web are fixed to respective ones of the lateral members on opposite sides of an imaginary reference plane passing orthogonally through both of the lateral members. In particular, in a wall frame, the lateral members are mounted at opposite ends thereof to end plates consisting of other construction beams according to the present invention. When used in a frame of a building structure, the lateral members of the end plates on the same side are attached to the surrounding structure, leaving the other side of the frame resiliently free floating.

16 Claims, 5 Drawing Sheets

RESILIENT CONSTRUCTION MEMBER

TECHNICAL FIELD AND INDUSTRIAL APPLICABILITY OF THE INVENTION

The present invention relates to members used in construction, especially in applications where the importance of sound attenuation and isolation is significant. In particular, the present invention relates to construction members used to construct building structures in which sound transmission from one room to another is to be prevented or reduced.

BACKGROUND OF THE INVENTION

In general, it is conventionally known to resiliently mount a wall or ceiling in order to isolate sound or attenuate transmission therethrough.

U.S. Pat. No. 3,445,975 to Nelsson discloses a partition in which first and second lath panels are held against a metallic stud, channel, or furring member by a clip fastener. One portion of the stud, channel, or furring member is cantilevered away from the portion at which the lath panels are clipped thereto. According to Nelsson, this permits the free portion of the stud, channel, or furring member to flex as the lath panels mechanically respond to sound waves incident thereon. The remainder of the structure dampens this surface movement, reducing sound transmission to the opposite surface of the partition.

U.S. Pat. No. 3,324,615 to Zinn discloses a construction member having a plurality of laterally extending supporting tabs by which wallboard segments are resiliently mounted.

U.S. Pat. No. 3,046,620 to Tvorik et al. discloses a ceiling hanger member whereby a furring strip (to which a ceiling member is attached) is resiliently attached to a joist, such that the weight of the furring strip and ceiling member resiliently separates the furring strip from the joist.

Another known method of sound attenuation is to build a wall frame in which studs are laterally staggered relative to a toe plate and head plate. Therefore, alternate studs are used to mount wall board on respective sides of the frame so that a given stud is spaced away from one of wall boards.

Unfortunately, the foregoing conventional methods of noise attenuation are problematic in that they generally move away from basic construction methods and thereby increase complexity and cost. For example, they require additional parts (such as Tvorik et al. and Nelsson) or specially made parts (such as the channel member with specially formed support tabs, as in Zinn). The staggered stud arrangement necessarily results in a thicker wall partition which reduces the area of the room whose walls are framed in this manner, and increases the cost of the toe and head plates.

In addition, nail fasteners generally cannot be used with metal members, thereby undesirably restricting available construction methods.

In addition to the devices for sound attenuation described hereinabove, a wood I-beam is commercially available (e.g., under the brand name "BCI Advantage" from Boise Cascade Corporation) that comprises a pair of wood members with a rigid wooden panel extending therebetween. However, because the wooden panel is essentially non-resilient, this I-beam offers little or no sound attenuation benefit.

SUMMARY OF THE INVENTION

The present invention is therefore directed to a construction member that relies on resilient flexibility in order to attenuate sound transmission therethrough, but also more closely conforms to conventional building members in order to minimize or eliminate the need for any special handling or the like in use.

In particular, the present invention is directed to a construction beam member sized comparably to conventional wood beams (for example, 2"×4" or 2"×6"). The beam comprises a pair of spaced of lateral members having a resilient web extending therebetween. Ends of the resilient web are fixed to respective ones of the lateral members on opposite sides of an imaginary reference plane passing orthogonally through both of the lateral members. The web is preferably relatively stiff, but permits a slight flexure between the lateral members. The lateral members are preferably made from an easily workable material such as wood.

BRIEF DESCRIPTION OF THE DRAWINGS

The present invention will be described in detail hereinbelow, with reference to the drawings appended hereto, in which.

DETAILED DESCRIPTION AND PREFERRED EMBODIMENTS OF THE PRESENT INVENTION

Figure 1:
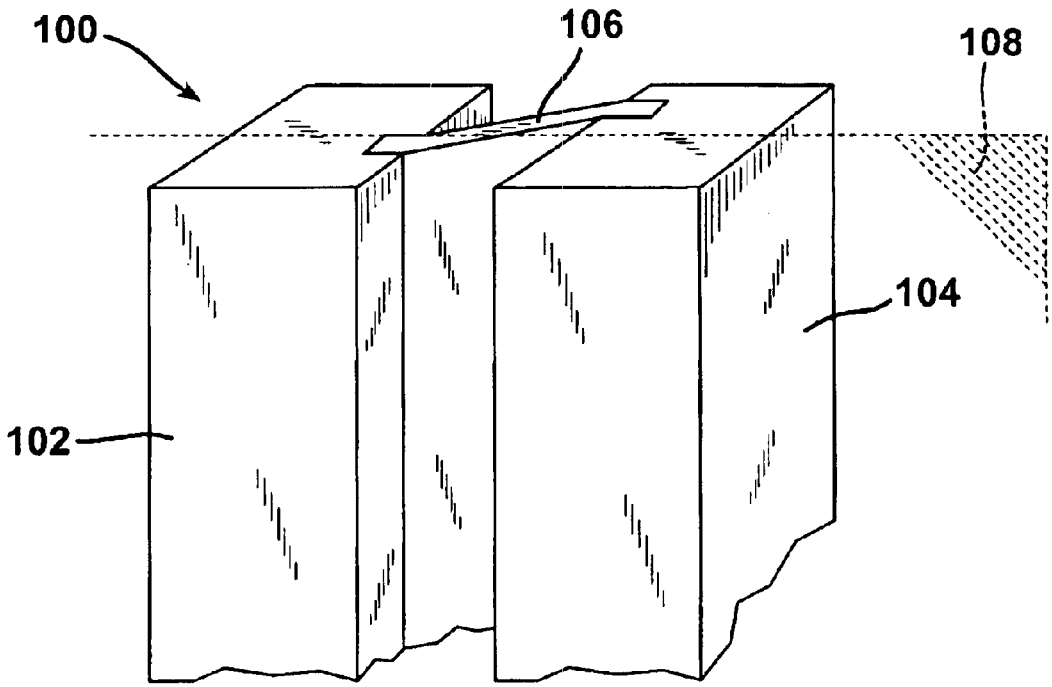
FIG. 1 is a partial perspective view of an end of a construction beam according to the present invention.
Figure 2:
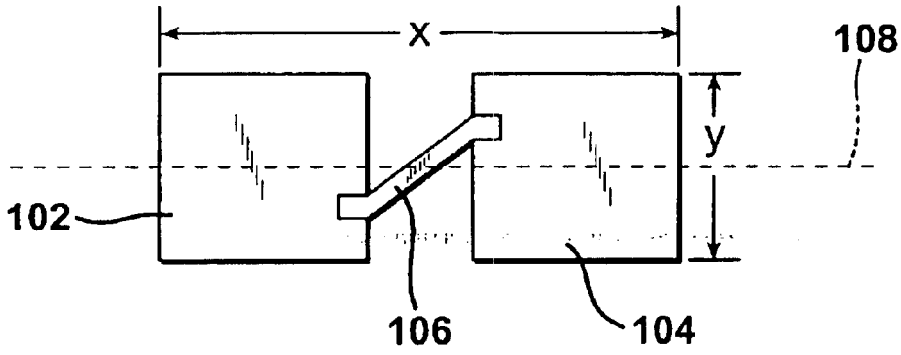
FIG. 2 is an end view of a beam according to the present invention.

FIGS. 1 and 2 illustrate a portion of a beam 100 according to the present invention. In general, beam 100 comprises lateral members 102 and 104 with a web 106 spanning therebetween.

FIGS. 1 and 2 depict an imaginary reference plane 108 passing orthogonally through the lateral members 102 and 104 as well as through the resilient web 106. Ends of the resilient web 106 are fixed to the lateral members 102 and

104 on opposite sides of the imaginary reference plane 108. Preferably, but not necessarily, the imaginary reference plane 108 is also a line of symmetry for each of the lateral members 102 and 104. Alternatively, the imaginary reference plane 108 divides each of the lateral members 102 and 104 in substantially the same manner.

Lateral members 102, 104 are generally squared in cross-sectional profile and have at least the same thickness y (see FIG. 2). Moreover, lateral beams 102, 104 are preferably identical so that each has the same width, proportionately spaced with web 106 therebetween so as to present an overall beam width x. Lateral members 102, 104 are preferably (but not necessarily) identical in shape so as to facilitate manufacture of beam 100 from one source of stock.

The beam 100 presents a cross section having a major dimension x and minor dimension y corresponding to any standard beam size (for example, 2"×4", 2"×6", and so on, without limitation).

According to the present invention, lateral members 102, 104 are elongate rigid members. Accordingly, a variety of suitably rigid materials could be used. However, lateral members 102, 104 are preferably (but not exclusively) made from wood, (in part, in keeping with an intent of the present invention to present a construction member very similar to those conventionally used in the art). Wood is also desirable because it can be worked, generally, in more ways than comparable metal members (e.g., it can be easily cut, driven with nails or screws, etc.). Not only can continuous lumber be used, but composite materials, such as plywood or wood particle board can be used. In addition, finger jointed wood members can be used according to the present invention. A plastic material reinforced with glass fibers may also be used in accordance with the present invention.

Web 106 is made from a relatively rigid material that has some flexibility. If web 106 is relatively too flexible, lateral members 102, 104 have too much relative freedom of movement and beam 100 is no longer, overall, a rigid member. If web 106 is relatively too stiff, then the benefits of sound isolation/attenuation are lost. Generally, web 106 may be made from any suitably stiff and resilient material, including (without limitation) rubber, asphalt, plastic or other resilient polymeric material.

Figure 4:
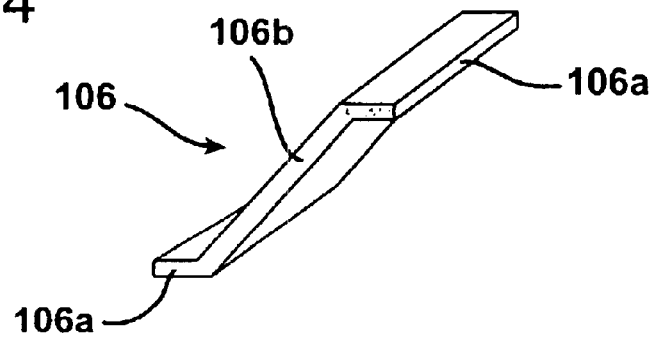
FIG. 4 is a perspective view of an example of a linkage for linking lateral members in a beam according to the present invention.

In one example of the present invention, web 106 is made from galvanized 22 gauge steel. As seen in FIG. 4, web 106 includes edge portions 106*a* and an intermediate portion 106*b*. Edge portions 106*a* are embedded in lateral members 102, 104, and intermediate portion 106*b* extends obliquely between lateral members 102, 104. However, intermediate portion 106*b* may, most generally, extend between lateral members 102, 104 in any orientation so long as flexure between lateral members 102, 104 is relatively easy (compared to, for example, an intermediate portion extending straight across the gap between lateral members 102, 104, which does not readily flex).

It is noted that the use of galvanized steel as described here may offer additional ancillary benefits, such as improved fire safety protection.

Edge portions 106*a* are embedded in lateral members 102, 104 in any conventional manner. One possible method (not illustrated) is to form grooves in lateral members 102, 104 that are wider than the thickness of edge portions 106*a*. Once edge portions 106*a* are suitably disposed in the respective grooves, additional strips of material (such as wood) are pressed into the remaining space in the grooves, such that edge portions 106*a* are wedged into place and retained in the grooves.

Web 106 may extend continuously substantially the entire length of lateral members 102, 104. However, when beams 100 are used in construction, it is useful to provide a plurality of spaced apart webs 106, such that piping, wiring and the like can be passed through the openings between webs 106 (see FIG. 3).

Figure 3:
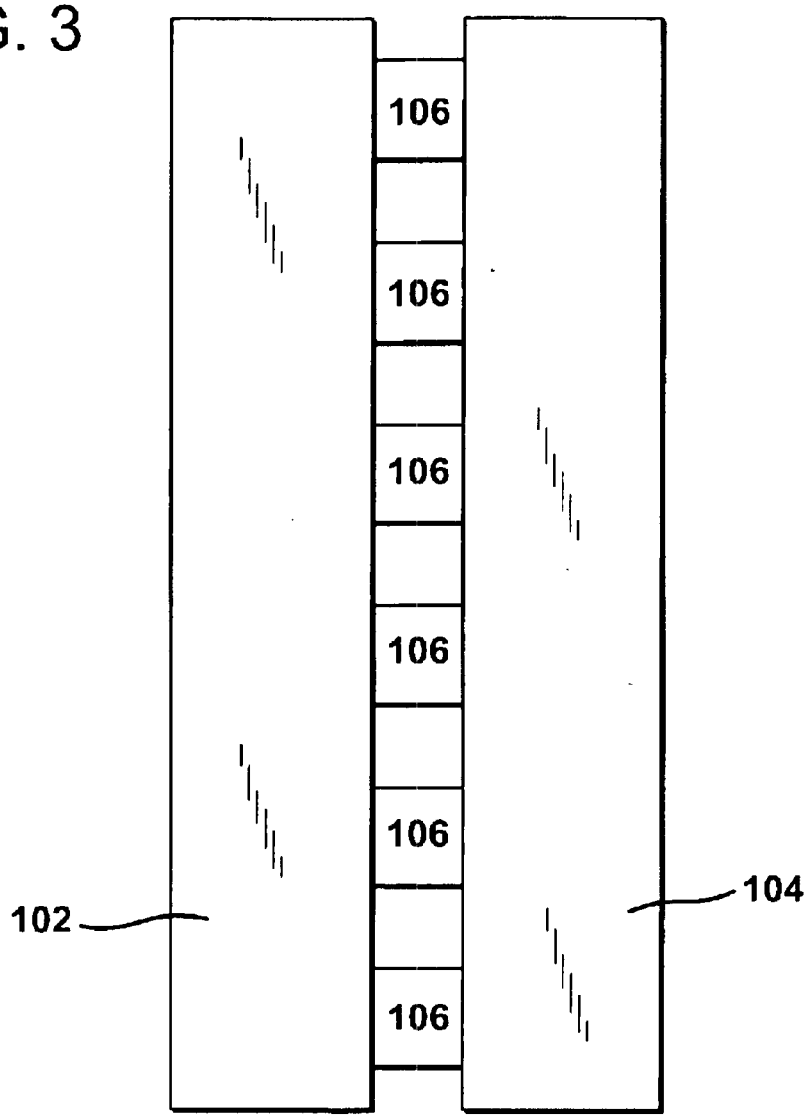
FIG. 3 is a plan view of a beam according to a different embodiment of the present invention.

Whether one or a plurality of webs 106 are provided, it is specifically contemplated that beams 100 are provided in standardized lengths (e.g., 8') as seen in FIG. 3 and can be cut down as required.

As mentioned above, it is an important feature of the present invention to provide a construction member that can be used like conventional construction beams. Accordingly, FIG. 5 is a partial perspective view of a frame work (as might be used for walls in a building).

Figure 5:
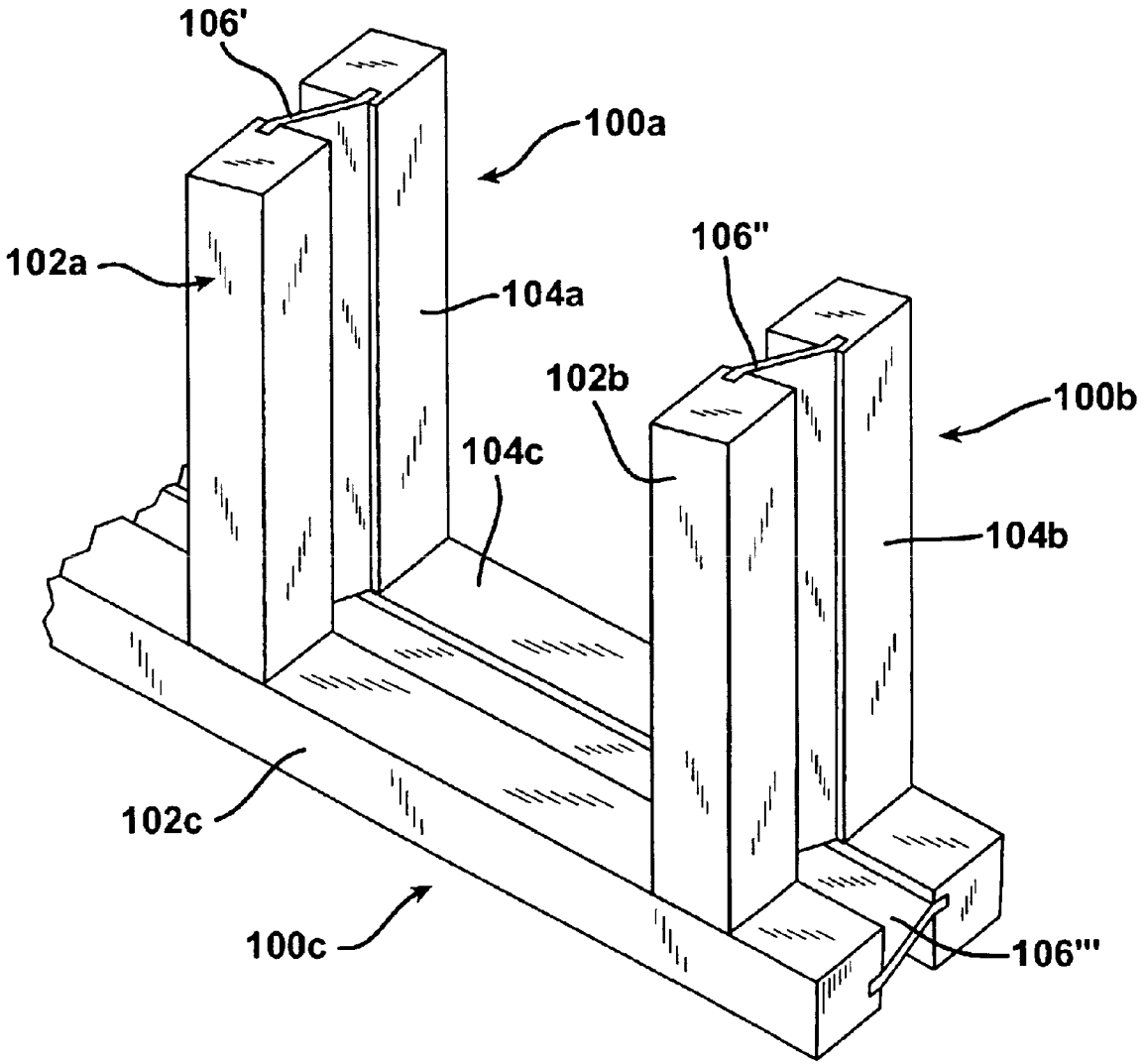
FIG. 5 is a partial perspective view of a framework for mounting wallboard or the like, utilizing beams according to the present invention.

As seen in FIG. 5, beams 100*a*, 100*b* are mounted as studs on a laterally extending beam (i.e., a head plate or toe plate) 100*c*. (Another laterally extending beam (not shown) is provided at the other end of beams 100*a*, 100*b*.) The structure of each of beams 100*a*–100*c* is in accordance with the description of the present invention hereinabove, and will not be repeated here. Attention is drawn to the manner in which lateral members 102*a* and 102*b* and 104*a* and 104*b* are mounted with respect to lateral members 102*c* and 104*c*, respectively, with nails, screws or any other conventional fasteners (not shown here). Accordingly, it can be appreciated that one side of the frame (i.e., lateral members 102*a*–102*c*) are resiliently separated by way of respective webs 106', 106", and 106'" from the other side of the frame (i.e., lateral members 104*a*–104*c*). Accordingly, sound impinging on a wall member mounted on one side of the frame is attenuated upon transmission to the other side of the frame because of the resilience of webs 106', 106", and 106'".

Furthermore, it is possible to resiliently mount a wall so that it acts like a diaphragmatic sound absorber. In particular, only one "side" of the frame assembly (e.g., lateral member 104*c* and/or lateral members 104*a*, 104*b*) is fixed to the surrounding structure, and the other side of the frame assembly has wall board or the like mounted thereon (i.e., on lateral members 102*a*, 102*b*), without attachment to the surrounding structure. The wall is therefore mounted on the "free" or "floating" side of the studs.

In order to enhance the effect of decoupling the one side of the wall frame from the surrounding structure, it is desirable to provide a soft gasket (made from, for example, foam rubber) between the lateral beam 100*c* and the surrounding structure (i.e., the ceiling and/or floor). This promotes relatively free movement of the one side of the frame that is not fixed to the surrounding building structure.

To further enhance the effect of decoupling the wall from the surrounding structure, it is preferable to provide flexible joint material at junctions between wall board segments, including at corners of rooms. Therefore the wall surface is visually continuous, but physically decoupled, in order to take advantage of the resultant sound attenuation effects.

Also, it is very desirable to provide additional sound and/or thermal insulation in the spaces defined by the studs and end plates. Such insulation can be of any conventional type, including blown, rolled or batting, foam board, etc. The addition of such insulation enhances sound attenuation effects resulting from the present invention.

Figure 6:
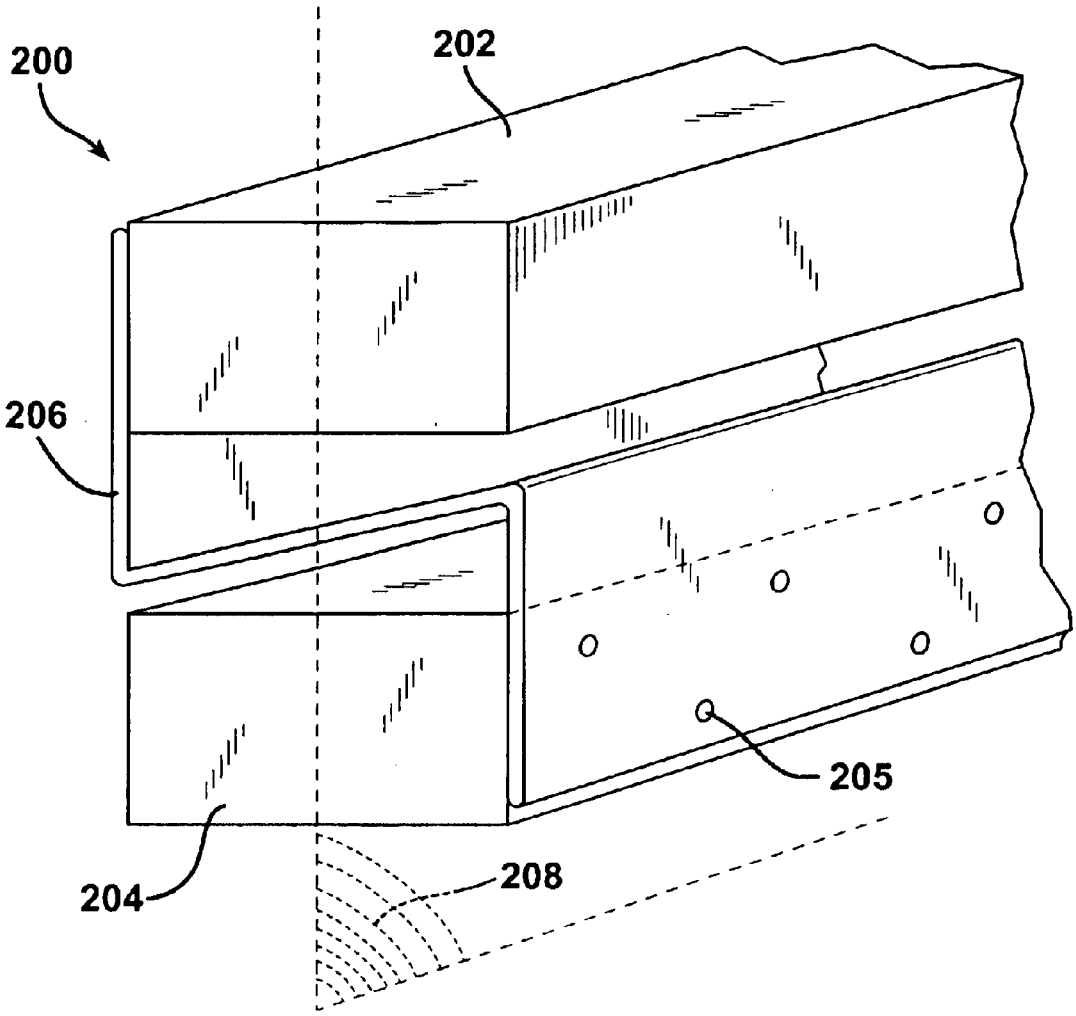
FIG. 6 is a partial perspective view of a beam according to yet another embodiment of the present invention.
Figure 7:
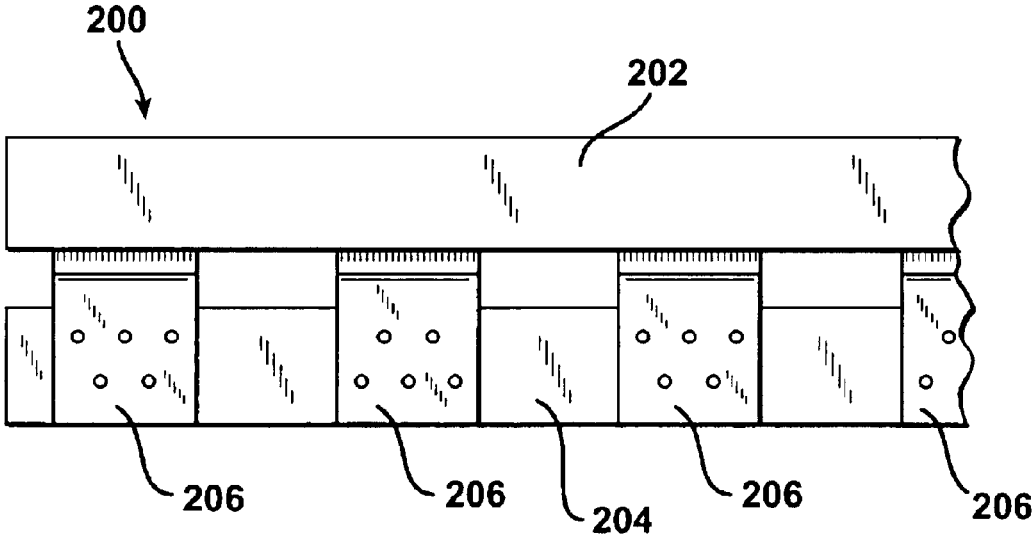
FIG. 7 is a plan view of a beam according to the embodiment of the present invention shown in FIG. 6.

FIGS. 6 and 7 are a partial perspective view and a partial plan view, respectively, of beam 200, in accordance with another embodiment of the present invention.

The design concept underlying beam 200 is fundamentally similar to that of beam 100. Like before, lateral members 202 and 204 are provided, and are resiliently spaced apart from each other by web 206. Unlike web 106 in beam 100, however, web 206 is not embedded in lateral members 202, 204. Instead, web 206 is fixed (by any conventional means, such as nails, as shown in FIGS. 6 and 7) relative to opposite faces of lateral members 202, 204 along the major dimension of the beam cross section.

An imaginary reference plan 208 is depicted in FIG. 6. The imaginary reference plane 208 relates to the lateral members 202 and 204 similarly to how the imaginary reference plane 108 of FIGS. 1–2 relates to the lateral members 102 and 104 in both the preferred and alternative arrangements.

As in the first embodiment, a plurality of spaced apart webs 206 may be provided along the length of beam 200 (see, for example, FIG. 7).

Web 206 is preferably made from a material that is slightly more flexible than that used for web 106, such as 24 gauge galvanized steel.

Initial comparative testing has been undertaken comparing the sound attenuation characteristics of conventional construction members versus beam 100 and beam 200. Initial results indicate that beam 100 has greater than expected attenuation characteristics, and that beam 200 should have even better attenuation performance than beam 100. This latter effect is thought to be caused by the shape and orientation of web 206, which more easily permits a normal compression between lateral members 202, 204.

Figure 8:
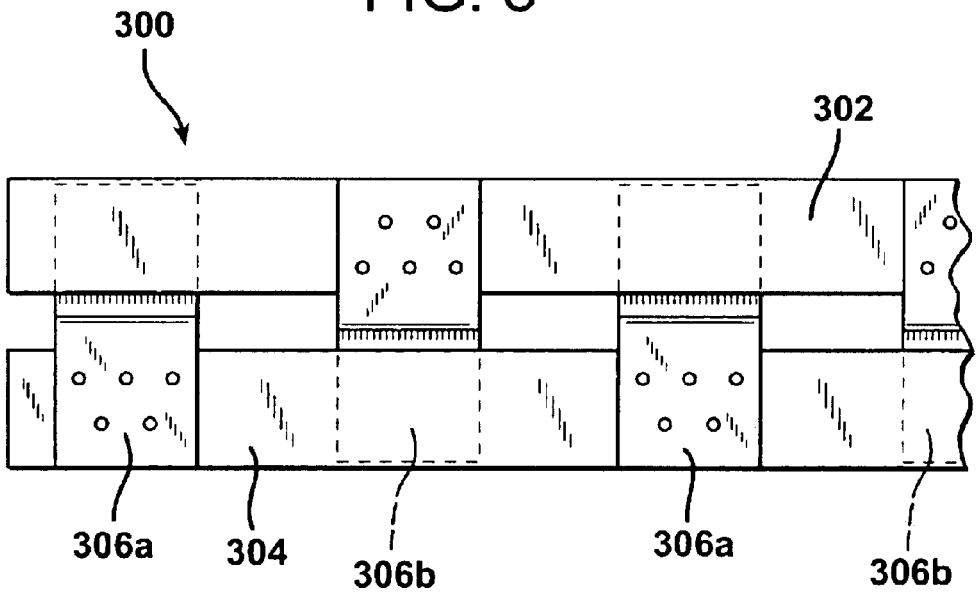
FIG. 8 is a plan view of a variant of the beam shown in FIG. 7.

In addition, as a variation of the embodiment illustrated in FIG. 7, the plurality of webs are alternately arranged so that the portion of the webs extending obliquely thereacross alternates (thereby crossing each other, as seen from an end of beam 200) (see FIG. 8). In FIG. 8, beam 300 comprises lateral beams 302 and 304, and includes a plurality of first webs 306a which are spaced from and alternate with a plurality of second webs 306*b*. Accordingly, respective intermediate portions of webs 306*a* and 306*b* criss-cross as seen from an end of beam 300.

Inasmuch as sound that one seeks to attenuate or isolate is typically physically unique relative to particular environments (e.g., a home theater room, a movie theater, a machine shop, a recording studio, a concert hall), it is an important feature of the present invention to provide a construction member that can be "tuned" in order to tailor its sound attenuation properties for a specific environment. In other words, a beam according to the present invention can be specifically manufactured so that its resilient properties (in terms of, for example, spring constant) are made to correspond to a particular kind of sound (especially in terms of its frequency) so that sound attenuation can be maximized.

Such "tuning" can be accomplished by varying the thickness of web 106, 206, either uniformly or variably over the entire area of web 106, 206. In addition, notches, slits, or other openings can be formed in web 106, 206 to control the resilience of web 106, 206 in accordance with known principles of physics. In addition, suitably sized perforations or openings in a continuous web can be formed so as to create a tunable Helmholtz resonator effect between adjacent cavities defined between studs in the framework illustrated in FIG. 5. By altering the number and/or size of the perforations or openings, a resultant Helmholtz resonant frequency can be controlled, at which attenuation of sound at that frequency is maximized. It should be noted that this is different from reference to a plurality of webs as shown in FIGS. 3, 7, and 8.

It can therefore be appreciated that adjoining rooms may be constructed (e.g., adjoining musical studios) such that each room can be tuned in accordance with its respective mode of use. In particular, this may be accomplished by constructed "double wall" framework, where two frames of the structure illustrated in FIG. 5 are constructed face-to-face, such that the respective opposing sides of the frames are fixed to the surrounding building structure and their respective opposite sides are left free floating in the manner discussed above.

Although construction members according to the present invention have been described hereinabove for wall frames and the like, they are also contemplated for use in mounting floating ceilings which are acoustically isolated from a building structure. In addition, construction members according to the present invention may also be used in floor construction.

In particular, a construction member for mounting a floating ceiling may be used by fixing one of the lateral members to the building structure and fixing a ceiling member to the free floating lateral member (i.e., the lateral member not fixed to the building structure).

Figure 9:
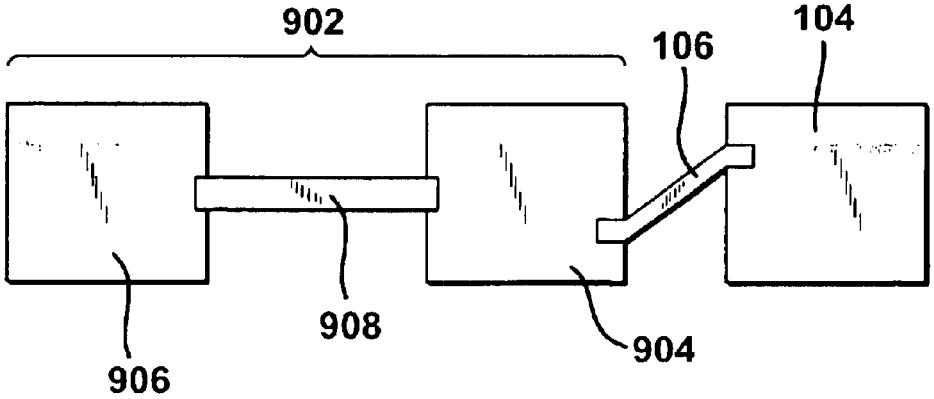
FIG. 9 is an end view of a beam according to the invention that incorporates an I-beam.

Although the use of substantially identical lateral members is contemplated according to the present invention, it is expressly within the scope of the present invention to use dissimilar lateral members. For example, one of the lateral members 102, 104 shown in FIG. 2 may be replaced by a conventional wood I-beam of the type described above. In particular as in FIG. 9, web 106 may be embedded in the flange portion 904 of the wood I-beam 902 (that also includes another flange portion 906 with a rigid web 908 between the flanges 904 and 906), in the manner disclosed above.

Although the present invention is directed primarily to construction members made from non-metal materials, the design concepts may be of interest in the manufacture of metal studs comprising a pair of metal members with a resilient web extending therebetween in accordance with the foregoing description. In particular, a metal stud using the inventive principles disclosed herein could be made from a single piece of sheet metal, formed into shape.

The present invention being thusly described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A beam comprising:

a pair of spaced apart lateral members; and at least one resilient web extending between said respective pair of said lateral members and having respective end portions fixed to respective ones of said lateral members on opposite sides of an imaginary reference plane passing orthogonally through both of said lateral members;

wherein said end portions are fixed to respective facing sides of said lateral members, said facing sides being parallel to said imaginary reference plane.

2. The beam member according to claim 1, wherein said lateral members are squared in cross-section.

3. The beam member according to claim 1, wherein said web extends obliquely between said lateral members.

4. The beam member according to claim 1, wherein said web is made from metal.

5. The beam member according to claim 4, wherein said web is made from galvanized steel.

6. The beam member according to claim 4, wherein said web is made from 22 gauge stock or thinner.

7. The beam member according to claim 5, wherein said web is made from 22 gauge stock or thinner.

8. The beam member according to claim 1, wherein said lateral members are made from wood.

9. The beam member according to claim 1, wherein said lateral members are made from wood particle board.

10. The beam member according to claim 8, lateral members are made from finger jointed wood segments.

11. The beam member according to claim 1, wherein said end portions are fixed in grooves formed is said lateral members, respectively.

12. The beam member according to claim 1, wherein said end portions are fixed to respective opposite sides said lateral members.

13. The beam member according to claim 1, wherein said web includes at least one opening therein sized in accordance with Helmholtz resonator principles so as to correspond to predetermined sound frequency.

14. The beam member of claim 1, wherein said spaced apart lateral members are connected by a vibration damping spacer interposed therebetween, whereby said spaced apart lateral members are elastically disposed relative to each other.

15. The beam member according to claim 1, wherein one of said lateral members is and I-beam, a respective said end portion of said resilient web being fixed to a flange portion of said I-beam.

16. The beam member according to claim 1, comprising a plurality of spaced apart said web extending between respective pairs of said lateral members.

* * * * *

UNITED STATES PATENT AND TRADEMARK OFFICE

CERTIFICATE OF CORRECTION

PATENT NO. : 6,755,003 B1
APPLICATION NO. : 09/209308
DATED : June 29, 2004
INVENTOR(S) : McGrath et al.

It is certified that error appears in the above-identified patent and that said Letters Patent is hereby corrected as shown below:

Column 8, Line 3 - Should read “claim 8, wherein said lateral”
Column 8, Line 9 - Should read “opposite sides of said”
Column 8, Line 14 - Should read “to a predetermined”
Column 8, Line 21 - Should read “members is an I-beam,”
Column 8, Line 25 - Should read “said webs extending between”

Signed and Sealed this

Eighteenth Day of July, 2006

JON W. DUDAS
*Director of the United States Patent and Trademark Office*